US008100599B1

(12) United States Patent
Guiragossian

(10) Patent No.: US 8,100,599 B1
(45) Date of Patent: Jan. 24, 2012

(54) HANDHELD SURFACE CLEANING DEVICE

(76) Inventor: Raffi Guiragossian, Long Beach, CA (US)

( * ) Notice: Subject to any disclaimer, the term of this patent is extended or adjusted under 35 U.S.C. 154(b) by 386 days.

(21) Appl. No.: 12/504,660

(22) Filed: Jul. 16, 2009

Related U.S. Application Data

(60) Provisional application No. 61/081,387, filed on Jul. 16, 2008.

(51) Int. Cl.
*B43K 5/00* (2006.01)

(52) U.S. Cl. ..... 401/205; 401/206

(58) Field of Classification Search ..... 401/196, 401/205, 206, 169
See application file for complete search history.

(56) References Cited

U.S. PATENT DOCUMENTS

| | | | | |
|---|---|---|---|---|
| 3,306,497 | A | | 2/1967 | Kenney et al. |
| 3,701,478 | A | | 10/1972 | Tada |
| 4,434,915 | A | | 3/1984 | Kirk, Jr. |
| 4,747,720 | A | * | 5/1988 | Bellehumeur et al. ..... 401/205 |
| 5,201,093 | A | | 4/1993 | Wells et al. |
| 5,470,113 | A | | 11/1995 | Schwalm et al. |
| 5,667,138 | A | | 9/1997 | Crampton |
| 5,924,153 | A | | 7/1999 | Salley |
| 6,058,550 | A | | 5/2000 | Krueger et al. |
| 6,182,320 | B1 | | 2/2001 | Krueger et al. |
| 6,195,831 | B1 | | 3/2001 | Devaney |
| 6,438,783 | B1 | | 8/2002 | Reder et al. |
| 2003/0143016 | A1 | | 7/2003 | Kushner et al. |
| 2003/0204928 | A1 | | 11/2003 | Shockley, Jr. et al. |
| 2004/0103916 | A1 | | 6/2004 | Davis et al. |
| 2005/0121056 | A1 | | 6/2005 | Snaza |
| 2005/0279652 | A1 | | 12/2005 | Kushner |
| 2006/0113318 | A1 | | 6/2006 | May et al. |
| 2007/0009315 | A1 | | 1/2007 | Wu |
| 2007/0251554 | A1 | | 11/2007 | Sague |
| 2007/0292195 | A1 | | 12/2007 | May et al. |
| 2009/0152267 | A1 | | 6/2009 | May et al. |
| 2009/0152295 | A1 | | 6/2009 | May et al. |
| 2009/0152296 | A1 | | 6/2009 | May et al. |
| 2009/0196675 | A1 | | 8/2009 | May et al. |
| 2009/0255953 | A1 | | 10/2009 | May et al. |

* cited by examiner

*Primary Examiner* — Tuan Nguyen
(74) *Attorney, Agent, or Firm* — Marcia Devon

(57) ABSTRACT

A surface cleaning device comprising a cleaning element, optionally with an impermeable barrier between wetting and drying parts. The cleaning element may be supported by a main body, e.g., an elongated tubular form, having at least one main body hole for fluid to flow through it to the cleaning element. An inner body has at least one inner body hole and is slideable relative to the main body, in response to finger pressure and preferably an opposing biasing means, between a neutral position and a dispensing position. In the dispensing position, the locations of the inner body and main body allow fluid to flow from the inner body hole into the main body hole. In the neutral position, a seal is formed at least in part by the fit between the inner body and the main body for substantially preventing the flow. Preferably, a stopping component limits outward movement and anti-twist features resist twisting of the inner body relative to the main body.

20 Claims, 14 Drawing Sheets

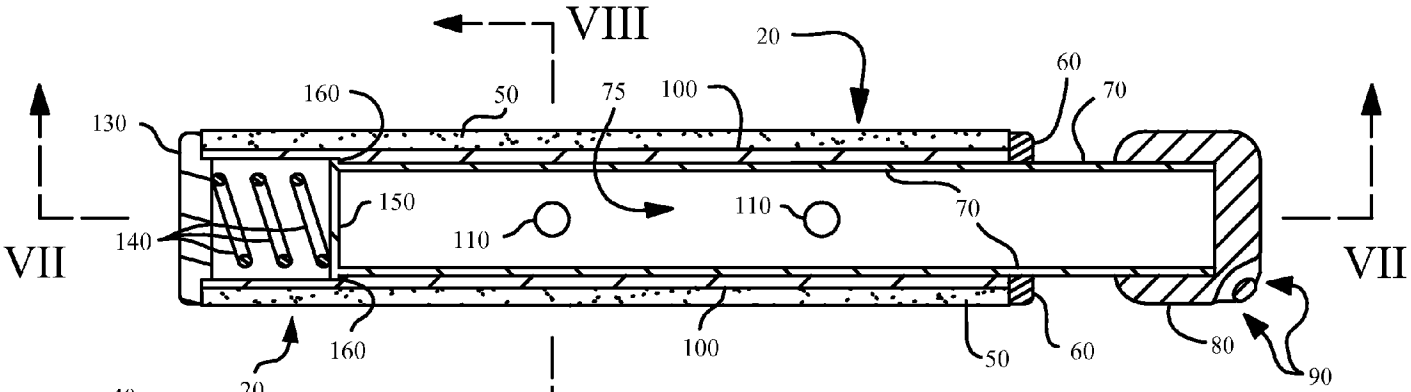
FIG. 24
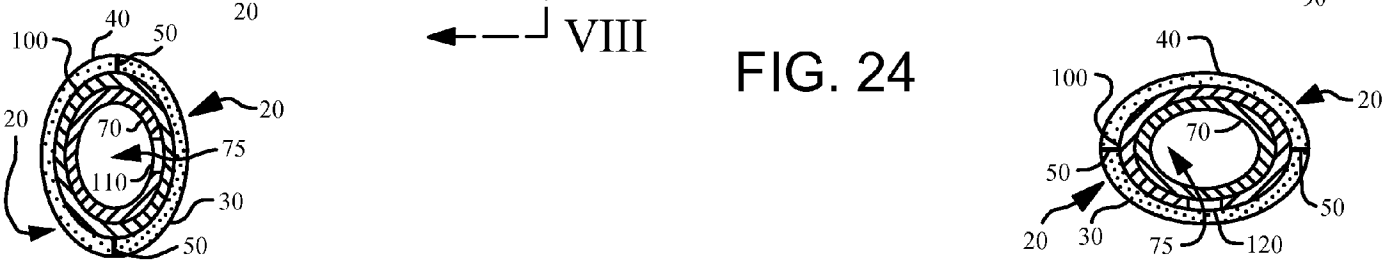
FIG. 25
FIG. 27
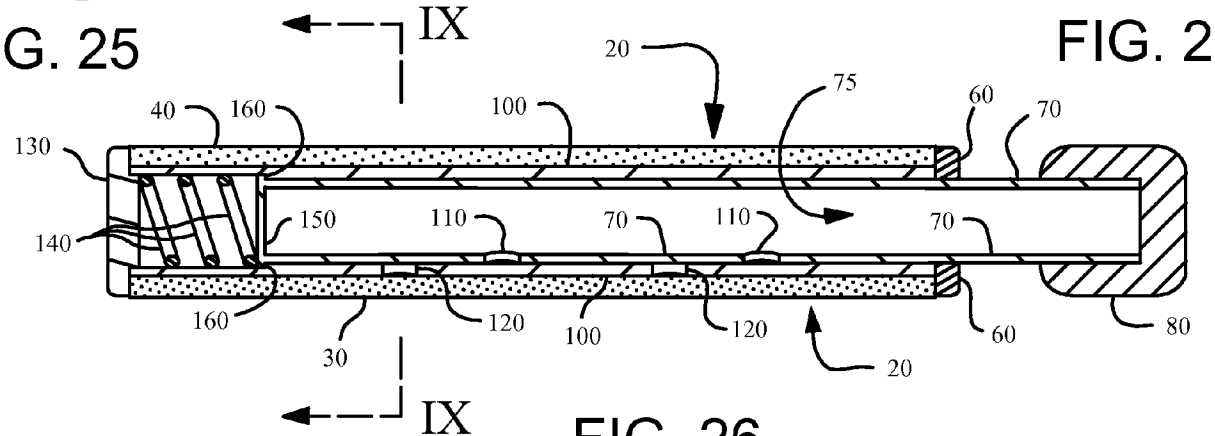
FIG. 26

HANDHELD SURFACE CLEANING DEVICE

CROSS-REFERENCE TO RELATED APPLICATIONS

This application claims the benefit of U.S. Provisional Application No. 61/081,387, which was filed on Jul. 16, 2008.

BACKGROUND OF THE INVENTION

The present invention relates to a self-contained cleaning device that can be held and operated by an individual using one hand, for cleaning smooth surfaces, particularly but not exclusively surfaces such as screens on portable personal items.

Many portable personal items have smooth surfaces, which typically become dirty and require cleaning from time to time. Examples of such items include handheld electronic devices such as computers, game and/or video players, personal data assistants, cameras, and cellular phones which have screens that are smooth and typically flat or slightly convex. Many such screens are now being made quite small for enhancing their portability, which can make them difficult to clean. Other examples of such items would include eye glasses (often made of material other than glass) and containers for such things as makeup, business cards, or cigarettes, which have surfaces that are smooth and flat enough for allowing them to be wiped by a cleaning element such as a soft cloth, sponge, or other material that is effective for cleaning the surface without unduly abrading it. Unfortunately, to be most effective for cleaning, the cleaning element generally must be wetted with some form of cleaning fluid comprising a solution that is useful for enhancing the cleaning of the surface. This makes it difficult to carry such cleaning element for ready use unless one also carries a separate container to either hold the pre-wetted cleaning element or to hold the fluid for dispensing it onto (which as used herein includes "into") a dry piece of the cleaning element (thus wetting it) just before it is to be used (thereafter presenting a disposal problem). The convenience, ease, and appeal of cleaning such surfaces could be significantly enhanced if it could be done using a single self-contained handheld surface cleaning device.

It is believed that the present invention offers advantages over previous ideas for devices that help individuals clean surfaces of portable personal items.

SUMMARY OF INVENTION

As used throughout this specification, unless clearly indicated otherwise, the following terms have the definitions referred to or specified in this paragraph. Terms of direction, relative time, relative position, angular position, orientation, and shape are not intended to be limited to the exact direction, relative time, relative position, angular position, orientation, or shape referred to but are intended to be inclusive of approximations and substantial similarities to those directions, relative times, relative positions, angular positions, orientations, and shapes. The term "such as" is intended to suggest an example, without limitation to only that example. References to a thing occurring "while" something else occurs are not intended as a requirement that the thing be occurring for the entire time the something else occurs. The term "herein" is intended to include the drawings as well as the other sections of this specification (including the claims).

According to one aspect of the present invention, it is a handheld surface cleaning device, wherein the device comprises a cleaning element for cleaning at least a portion of a cleanable surface of another item (for example, a screen of a handheld electronic device, such as a cellular phone, camera, computer, PDA, or video/music player; lenses of a pair of eye glasses; or, a shiny/reflective surface of a case for carrying personal items such as makeup, jewelry, or cigarettes). As an added convenience, the cleaning device may be connected (or connectable) for example to the other item or to the individual (or the clothing of the individual) who is carrying the other item, e.g., via a lanyard, cord, chain, or strap, the cleaning device preferably comprising an attachment hole through which a strap or other connecting piece such as a clip or ring can pass in order to facilitate such attachment. The cleaning element has an element inner surface and an element outer surface and comprises a wetting part, the wetting part being capable of absorbing a cleaning fluid through the element inner surface and communicating the fluid to the element outer surface for application of the fluid onto the cleanable surface. Preferably, the cleaning element also comprises a drying part, which may optionally be separated, at least partially, from the wetting part by, for example, an impermeable barrier. (The cleaning fluid may be any available cleaning solution, whether one of the many commercially available fluid based detergents or a self-made solution, preferably a highly volatile one, such as, for example, 90 percent isopropyl alcohol, 5 percent white wine vinegar, and 5 percent lemon juice. The persistence and dissipation area of the fluid within the cleaning element may be significantly affected by the volatility of the fluid used and amount dispensed during any particular use of the cleaning device. Thus, those factors may be considered in determining the need or desirability of including an impermeable barrier, which is an option discussed herein for separating a wetting part of the cleaning element from a drying part of the cleaning element.) Preferably, the element outer surface can be rubbed against the cleanable surface, with aid of the fluid applied to the cleanable surface, for cleaning the cleanable surface without destroying (by, e.g., abrasion) the intended utility and/or attractiveness of the cleanable surface, such as its smoothness, transparency, shininess, and/or reflectivity. There are many available materials having the qualities outlined above that can be used for making the cleaning element, such as any soft (preferably also strong, durable, and supple), liquid-permeable cloth (such as terrycloth, felt, and other types of cloth that are commercially available for substantially abrasion-free cleaning of glass and/or plastic), as well as sponge or chamois material.

Such application of fluid may result in residual fluid being left on the cleanable surface. Therefore, again, preferably, the cleaning element also includes a drying part, the drying part being capable of drying (such as by absorbing and/or adsorbing) at least some of the residual fluid from the cleanable surface. The drying part may be made of any material that is capable of absorbing and/or adsorbing at least a portion of the fluid from the cleanable surface, which material may be the same as the material used for making the wetting part. And, optionally, the drying part may be separated from the wetting part by a substantially impermeable barrier (also referred to herein simply as an impermeable barrier and meaning a barrier of material that may, for example, be adhered to the edges of two pieces of material where they are joined together, and that at least impedes the flow of the fluid from the material on one side of the barrier to the material on the other side of the barrier). The cleaning element should be sufficiently soft and/or pliable for at least part of the cleaning element to substantially conform to the shape of at least a portion of the cleanable surface.

According to said aspect, the cleaning device also comprises a main body wherein the main body provides a structure for supporting the cleaning element, the main body preferably being in direct contact with at least part of the element inner surface. Preferably, the main body has an elongated tubular form onto which the cleaning element can be placed to form a sleeve about the main body. Although, it is believed preferable for the sleeve to completely surround a portion of the main body (as would a full sleeve), alternatively, the sleeve may be one that does not fully surround any portion of the main body, such as a sleeve that is not fully closed (e.g., a sleeve split and separated along its length). And, the main body comprises a main body hole (preferably at least two main body holes) through its side for allowing passage of the fluid from inside the main body to at least a portion of the cleaning element inner surface on the outside of the main body.

Also according to said aspect, the cleaning device comprises an inner body having within it a reservoir for holding at least some of the fluid ("holding" not requiring that the fluid be held permanently since the object is for the inner body to dispense at least some of the stored fluid while the cleaning device is in a dispensing configuration), with the base of the inner body (also referred to herein as the inner base) located within the main body and with an exposed portion of the inner body (also referred to herein as the inner body stem) extending outward from the main body. Preferably, a knob, which may have any shape against which finger pressure may be applied, is attached to (which includes a knob that is made as an integral part of) the outer (distal) end of the stem. And, preferably, at least a portion of the reservoir is located between the inner base and the knob.

The inner body is slideable longitudinally (inwardly and outwardly) relative to the main body, between a neutral position and a dispensing position. Preferably, the cleaning device also comprises a biasing means, such as a spring or other available compressible and/or expandable elastic item or substance, which is located and operable for resisting movement of the inner body from the neutral position toward the dispensing position but which resistance can be overcome by finger pressure against the knob to accomplish said movement (preferably, the resistance could be overcome by a modest amount of pressure such as the amount needed to produce a longitudinal force on the inner body of less than two pounds), and which tends to return the inner body from the dispensing position to the neutral position upon removal of said finger pressure.

The inner body comprises an inner body hole (preferably, at least two inner body holes with, again preferably, an inner body hole associated with each main body hole) through its side, the inner body hole being positioned for overlapping at least part of the main body hole with which it is associated while the inner body is in a dispensing position. Preferably, the fit between the inner body and the main body is sufficiently tight, and/or supplied with a grease or other available fluid-resistant lubricant, whether man-made or natural such as possibly beeswax (at least in the vicinity of the inner body hole(s)) for substantially preventing the flow of fluid from the inner body hole(s) into the main body hole(s) while the inner body is in a neutral position. A neutral position being any position of the outwardly-extended positions of the inner body (positions where the inner body hole(s) do not overlap and are positioned longitudinally outward of their respective associated main body hole(s)), thus a position at which the inner body can rest (relative to the main body) while there is no intent for it to dispense fluid. Preferably, the device includes a stopping component for both preventing the inner body from excessive longitudinal outward movement and holding the inner body at a selected neutral position relative to the main body. The stopping component preferably comprises a main body protrusion (preferably an annular, or partially annular, shoulder) extending radially inwardly from its inside wall and into the path of a protrusion such as an annular flange extending radially outwardly from the inner body base. Thus, when not intending to dispense fluid into the cleaning element, the inner body is simply allowed to remain (such as by the urging of the biasing means) in the neutral position; and, when intending to so dispense fluid, the inner body is pressed longitudinally inwardly (which should be possible for most users by holding and pressing the device between the forefinger and thumb) until an inner body hole at least partially overlaps an associated main body hole, which opens a path for communication of the fluid from the reservoir into the cleaning element.

And, preferably, the device is resistant to the inner body twisting relative to the main body, to help prevent misalignment circumferentially between the inner body holes and their respective main body holes. In accordance with the above noted aspect, the device includes anti-twist features (e.g., a part or set of parts, also referred to as anti-twist parts) for allowing the inner body and main body to be slideably engaged with one another to move (relative to each other) in only the longitudinal direction. Thus, in accordance with this aspect, the anti-twist features may include one, or both if so desired, of two means for resisting such twisting. The device may have a pin (also referred to as a rod) and a longitudinal groove (also referred to as a slot), such as a pin protruding radially out from the inner body wall and slideably engaging a longitudinal slot in the inner wall of the main body (or, the roles may be reversed, with the pin protruding from the main body inner wall into a longitudinal slot in the inner body). And/or, the device may have an inner body and a main body with oppositely matching non-circular shaped (as viewed through a transverse cross section) sidewalls where they interface one another. Either of these sets of anti-twist features can operate to resist the tendency for the inner body to twist relative to the main body.

It should be understood that the foregoing summary of one or more aspects and/or embodiments, or any of their parts, is not intended to limit any of the claims, which are based on the overall disclosure herein and limited only by the claims themselves and their equivalents. The present invention is intended to include all aspects, embodiments, and uses of it that are consistent with the disclosures herein, without limitation to the specific aspects and embodiments described or shown herein.

BRIEF DESCRIPTION OF THE DRAWINGS

The present invention will be more clearly understood by reference to this specification in view of the accompanying drawings, in which:

FIG. 24 is a front cross-sectional view of the embodiment in FIG. 21 as seen through section cut V-V, shown lying horizontally with the inner body in the neutral position.

FIG. 25 is a transverse cross-sectional view of the embodiment in FIG. 24 as seen through section cut VIII-VIII.

FIG. 26 is a right side cross-sectional view of the embodiment in FIG. 24 as seen through section cut VII-VII, shown lying horizontally with the inner body in the neutral position.

FIG. 27 is a transverse cross-sectional view of the embodiment in FIG. 26 as seen through section cut IX-IX.

DETAILED DESCRIPTION OF PREFERRED EMBODIMENTS

Figure 1:
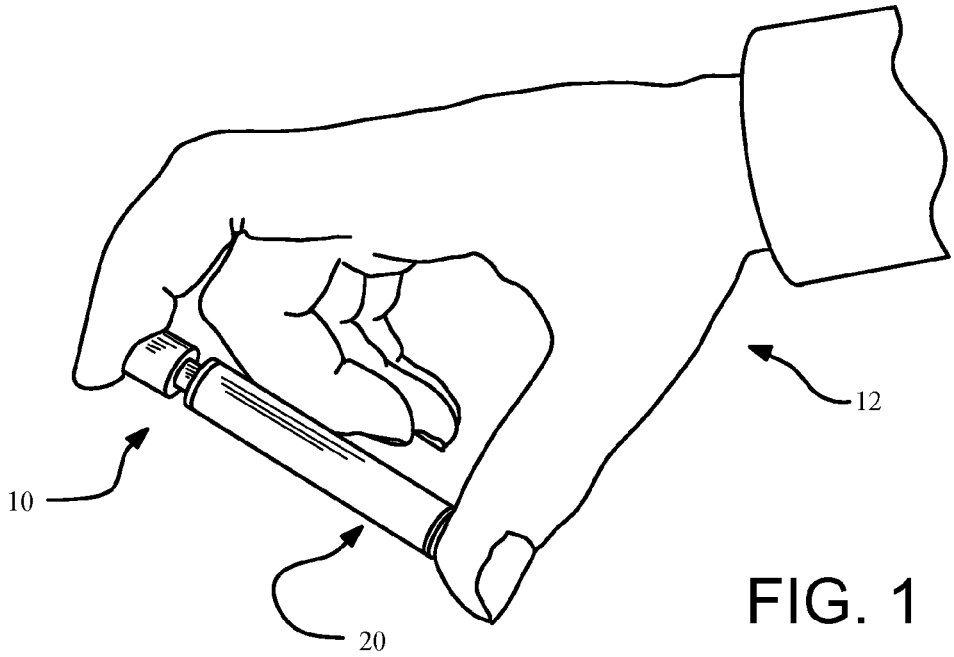
FIG. 1 is a perspective view of an embodiment (based on the alternate embodiment referred to in FIG. 19) of the present invention, shown held by hand.
Figure 2:
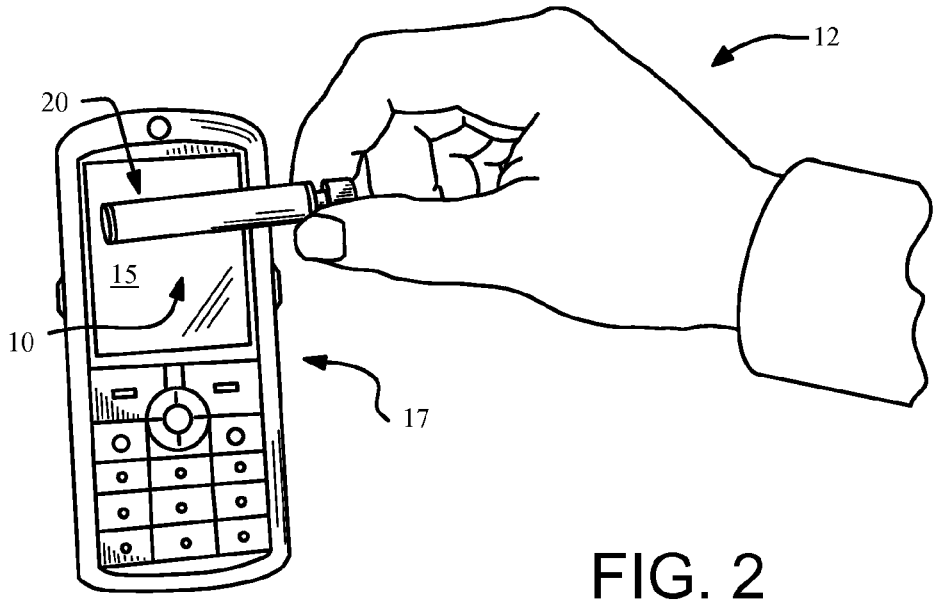
FIG. 2 is a perspective view of the embodiment in FIG. 1, shown held by hand and about to be used on the screen of an electronic device.

Referring to the drawings, FIG. 1 illustrates an embodiment of the present invention in a generic form of a handheld surface cleaning device 10 shown suitably sized for being held by a human hand 12 in a position for applying finger pressure against each of the two lateral ends of the cleaning device 10, which, when so applied in sufficient amount (preferably requiring less than the amount needed to generate a compressive force of two pounds on the cleaning device 10) can cause a portion of the cleaning element 20 to become wetted as further described below. In FIG. 2, the hand 12 is shown holding the cleaning device 10 close to a cleanable surface 15, such as a screen, on another item 17, such as a portable electronic device (for example, a multi-function cellular phone), for cleaning the cleanable surface 15 by rubbing it (preferably while the cleaning device is wetted) against said cleanable surface 15.

Figure 3:
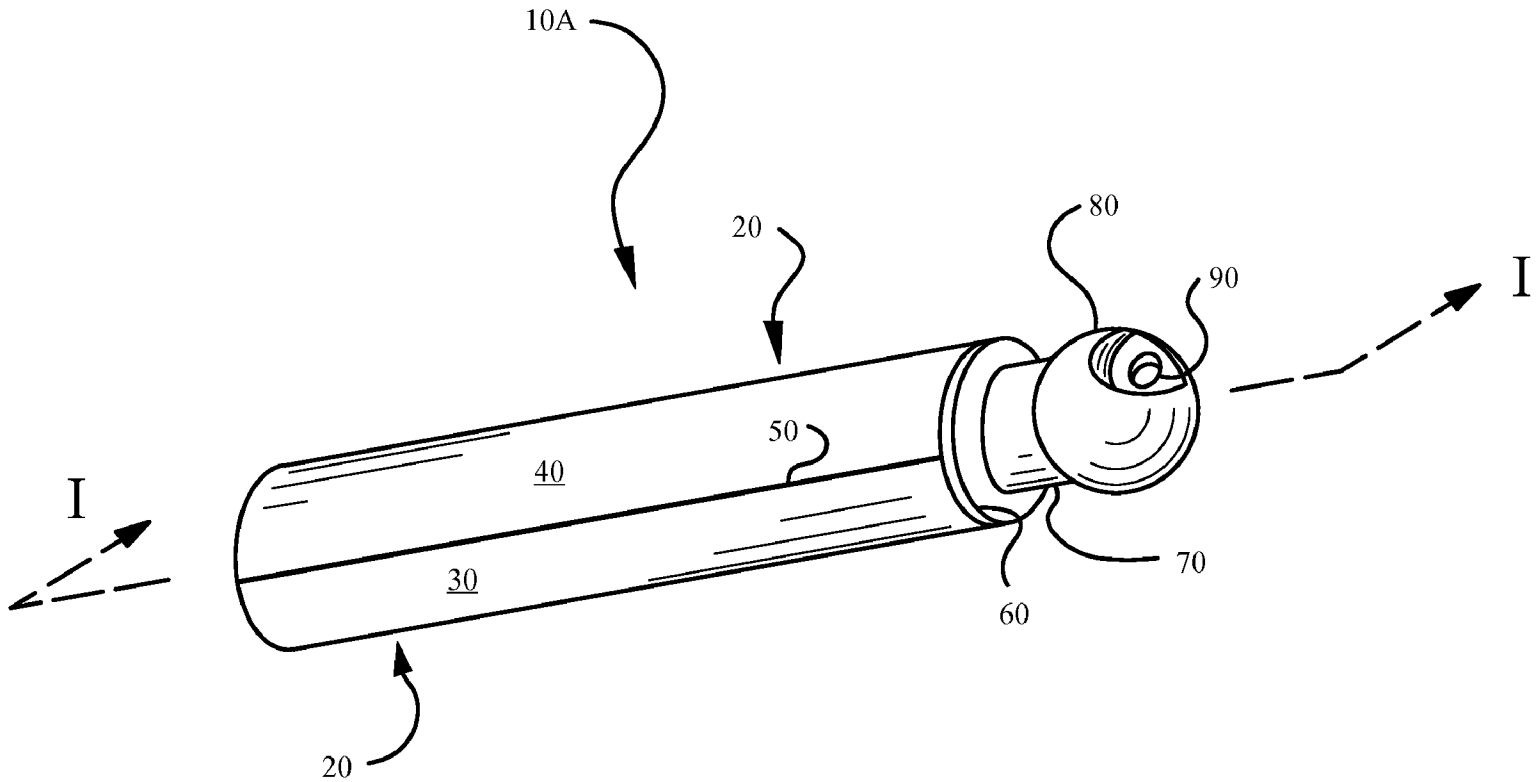
FIG. 3 is a perspective view of an embodiment of the present invention.

In FIG. 3, an embodiment of the cleaning device (which embodiment is referred to herein as first cleaning device 10A) is shown with an outer sleeve of a cleaning element 20 which, although optional, is shown in this embodiment divided into a wetting part 30 and a drying part 40, separated by an impermeable barrier 50. FIG. 3 also shows this embodiment with a bushing 60 located at the top edge of the cleaning element 20 and forming a collar-like piece through which a portion of an inner body 70 (shown more fully in, e.g., FIGS. 4-7) extends longitudinally, with the inner body 70 shown capped by a knob 80 for receiving application of pressure by a human finger (as illustrated in FIG. 1). As shown in FIG. 3, the knob has an attachment hole 90 through which a strap or other connecting piece such as a clip or ring can pass in order to facilitate attachment of the first cleaning device 10A to something else, such as to the person who will be using the first cleaning device 10A (or to his/her clothing) or, if so desired, to another item 17 that is, for example, to be cleaned frequently using the first cleaning device 10A.

Figure 4:
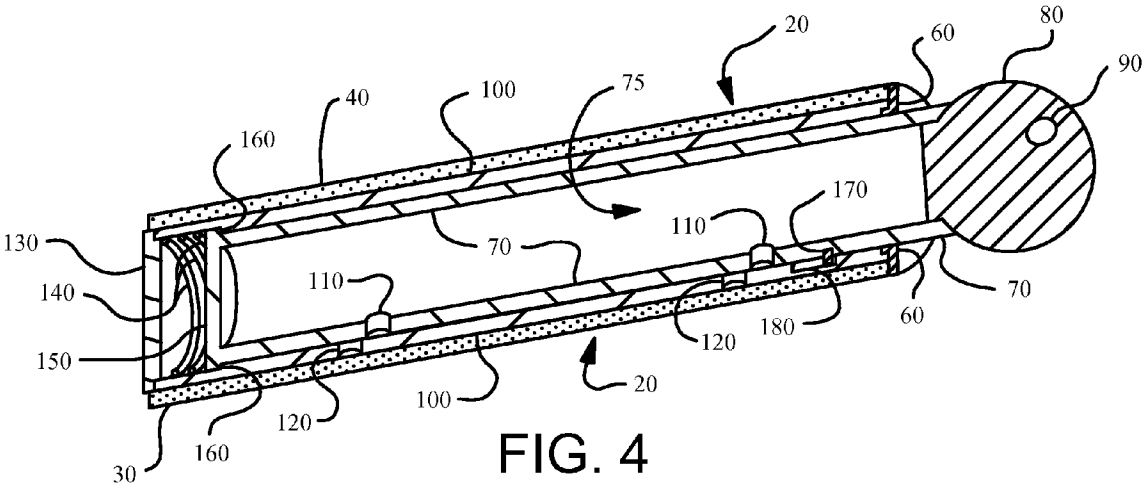
FIG. 4 is a perspective cross-sectional view of the embodiment in FIG. 3 as seen through section cut I-I, shown with the inner body in a neutral position (although not the only possible neutral position for this embodiment, it is used for convenience as the basis for references herein to this embodiment being in the neutral position).
Figure 5:
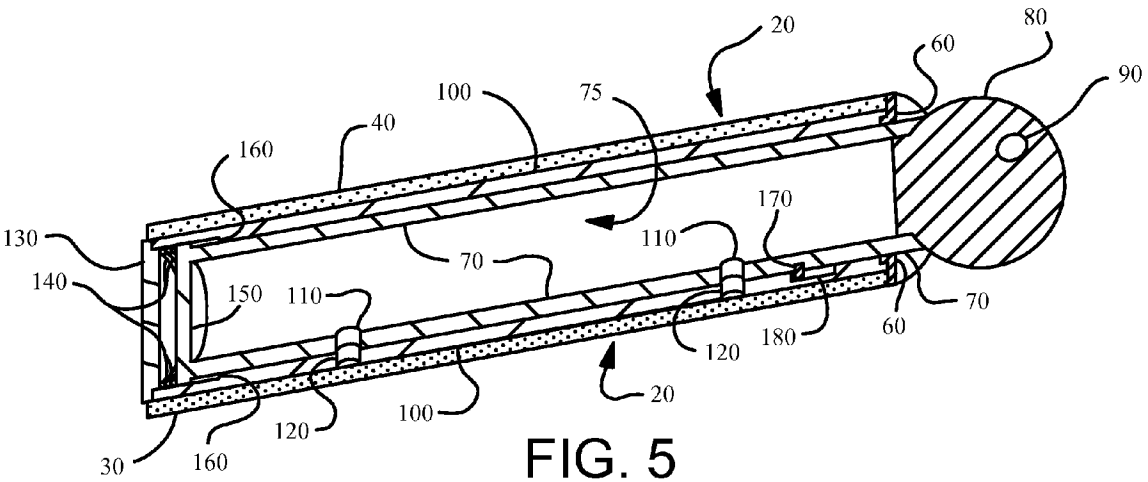
FIG. 5 is a perspective cross-sectional view of the embodiment in FIG. 3 as seen through section cut I-I, shown with the inner body in a dispensing position (same parenthetical note as in above reference to FIG. 4 except "neutral position" is replaced by "dispensing position").
Figure 13:
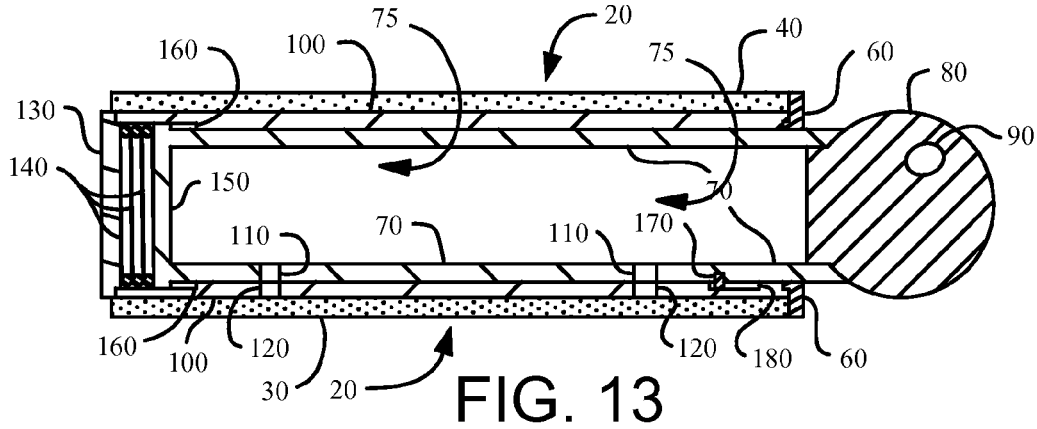
FIG. 13 is a right side cross-sectional view of the embodiment in FIG. 11 as seen through section cut III'-III, shown with the inner body in the dispensing position.
Figure 14:
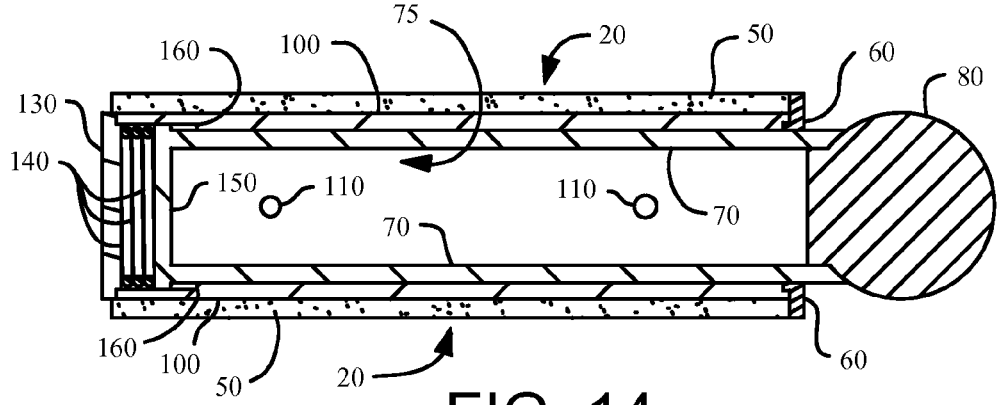
FIG. 14 is a front cross-sectional view of the embodiment in FIG. 10 as seen through section cut II-II, shown with the inner body in the dispensing position.

In the cross-sectional views shown in FIGS. 4 and 5 (as well as in FIGS. 12-14, and for an embodiment having a different transverse cross-sectional shape FIGS. 24, 26, 28 and 30), the cleaning device can be seen with a cleaning element 20 surrounding (in sleeve-like fashion) a main body 100, which in turn encloses preferably most of the inner body 70, wherein the inner body 70 is slideable longitudinally relative to the main body 100, and wherein the inner body 70 has a reservoir 75 for storage of cleaning fluid (not shown) and has two (although the number could be one or more than two) inner body holes 110 for allowing the fluid to pass out of the reservoir 75 through the sidewall of the inner body 70 (sidewall of the inner body is also referred to herein as inner body wall), the main body 100 has two (although, again, the number could be one or more than two) main body holes 120 for allowing fluid to pass through the sidewall of the main body 100 (sidewall of the main body is also referred to herein as main body wall), with each of the two inner body holes 110 positioned for it not to overlap any of the main body holes 120 while the inner body is in a neutral position, but to overlap at least part of at least one of the main body holes 120 while the inner body is in a dispensing position (neutral and dispensing positions are described more fully below).

The first cleaning device is shown in the cross-sectional view in FIG. 4 (as well as in FIG. 12, and for an embodiment having a different transverse cross-sectional shape, FIGS. 24 and 26) with the inner body 70 in a neutral position relative to the main body 100, wherein the inner body 70 is urged into said neutral position by a biasing device 140 (shown as a spring, although it could be any device capable of biasing the inner body 70 relative to the main body 100 in an outward longitudinal direction) situated between the inner body base 150 and the main body base 130. Preferably, the fit between the portions of the inner body comprising the inner body holes 110 and the portions of the main body comprising the main body holes 120, is made tight enough for preventing an unacceptable amount of leakage of the fluid from the reservoir 75 while the inner body is in the neutral position, without also preventing manual movement of the inner body 70 between the neutral and dispensing positions as further described herein. It is believed that such tightness may be accomplished readily with the aid of available lubricants (preferably ones that resist being dissolved by the cleaning fluid, such as grease or possibly beeswax) applied between the inner body and main body. In these figures, the inner body 70 is shown being prevented from outward longitudinal movement beyond the neutral position by the presence of an internal shoulder 160 formed by making the sidewall of the main body 100 thicker at the point where the shoulder 160 is to stop the outward longitudinal movement of the inner body base 150, which as is shown, is wider than the remainder of the inner body 70. Therefore, the inner body base 150 is prevented from moving outward longitudinally beyond the neutral position but free to move inward longitudinally but for the resistance provided (in addition to any incidental resistance such as from friction between the parts involved) by the biasing device 140, which resistance preferably can be overcome by human fingers pressing the knob 80 (thus, the inner body 70) toward the main body base 130. In these figures, the inner body is also shown guided by the bushing 60 proximate its distal end, the bushing 60 being shown having an opening through which the inner body can slide while moving longitudinally, inwardly and outwardly, relative to the main body 100, and the bushing 60 preferably acting as a seal for preventing leakage of the fluid (such as by use of an O-ring seal between the inner body 70 and the bushing 60).

Figure 12:
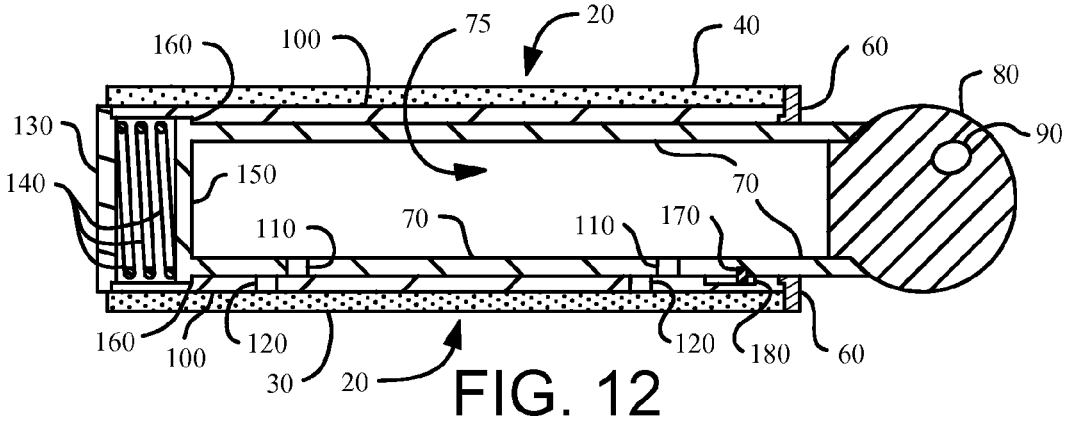
FIG. 12 is a right side cross-sectional view of the embodiment in FIG. 9 as seen through section cut I'-I', shown lying horizontally with the inner body in the neutral position. (Note that section cut I'-I' shown in FIG. 9 is the same as section cut I-I shown in FIG. 3, except each of those figures shows it from a different viewpoint).

FIGS. 4 and 12 show a longitudinal slot 180 (also referred to as a groove) recessed into the sidewall of the main body 100 engaged by a pin 170 (also referred to as a rod) that is fixed to and extends outwardly from the sidewall of the inner body 70, to serve as a set of anti-twist parts for preventing the inner body 70 from twisting relative to the main body 100, while, for example, the inner body is being moved back and forth between neutral and dispensing positions and/or the first cleaning device 10A is being otherwise manipulated for cleaning a surface.

The first cleaning device is shown in the cross-sectional view in FIG. 5 (as well as in FIGS. 13-14, and, for an embodiment having a different transverse cross-sectional shape, in FIGS. 28 and 30) with the inner body 70 in a dispensing position relative to the main body 100, wherein the inner body 70 is pressed into said dispensing position by overcoming the resistance to such movement, including the force of the biasing device 140, which is shown in these figures as compressed within the space remaining between the inner body base 150 and the main body base 130. In the dispensing position, as seen in these figures, the inner body holes overlap the main body holes enough to provide a pathway through which the fluid can pass from the reservoir to the cleaning element, the cleaning element preferably being made of a material that will absorb the fluid that contacts its inner surface and communicate at least some of the absorbed fluid to the outer surface of the cleaning element for application of at least some of the fluid onto a cleanable surface such as the screen 15 of the other item 17 illustrated in FIG. 2.

Figure 8:
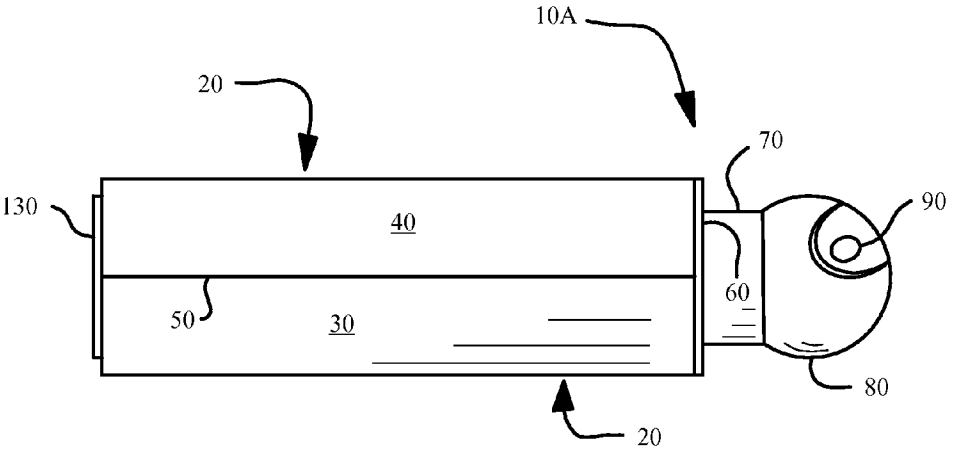
FIG. 8 is a right side view of the embodiment in FIG. 3, shown lying horizontally with the inner body in the neutral position.
Figure 9:
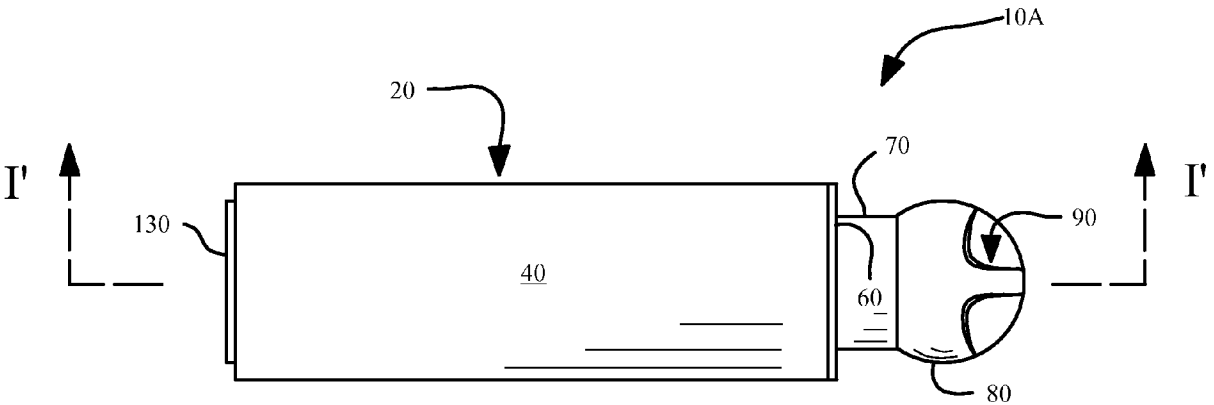
FIG. 9 is a front view of the embodiment illustrated in FIG. 8, shown with the inner body in the neutral position.
Figure 10:
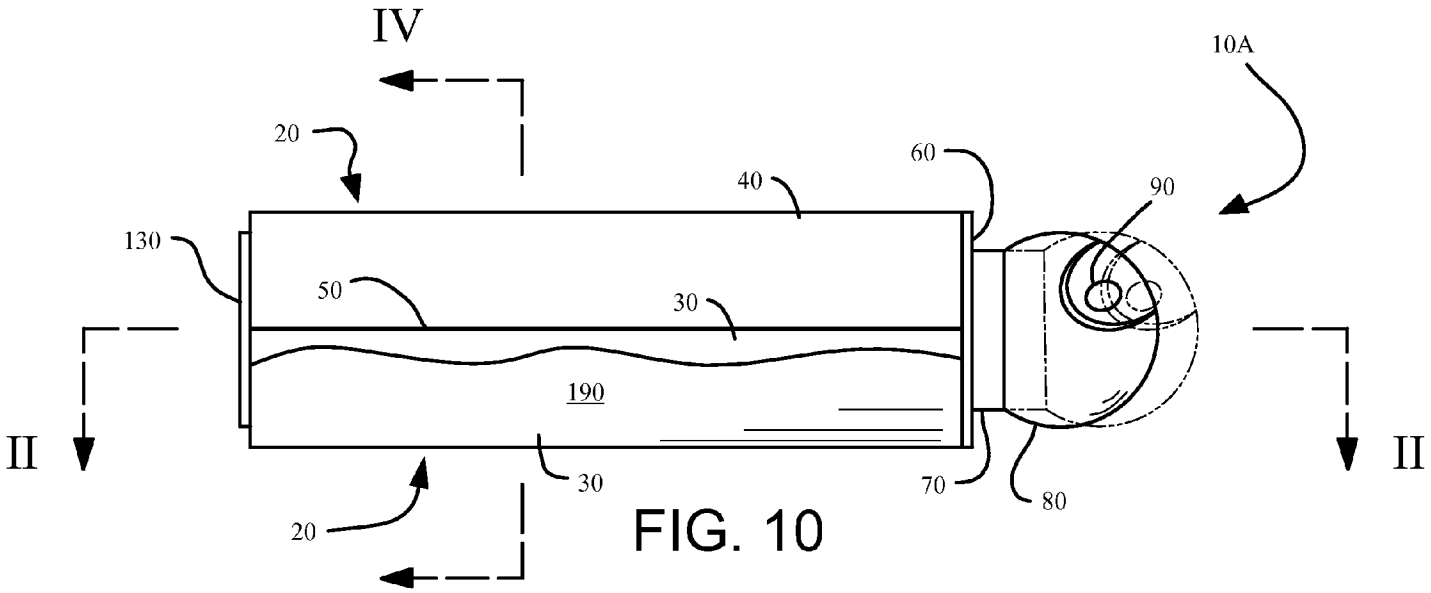
FIG. 10 is a right side view of the embodiment in FIG. 8, shown with the inner body in the dispensing position with phantom lines included as a reference to the neutral position.
Figure 11:
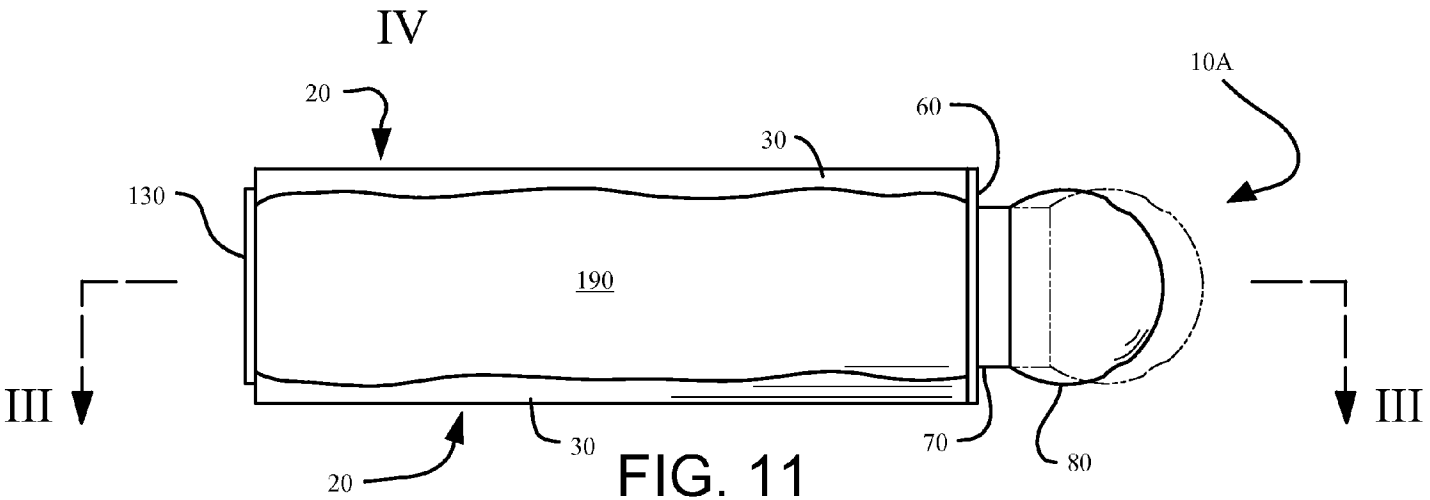
FIG. 11 is a back view of the embodiment in FIG. 8, shown with the inner body in the dispensing position with phantom lines included as a reference to the neutral position.
Figure 20:
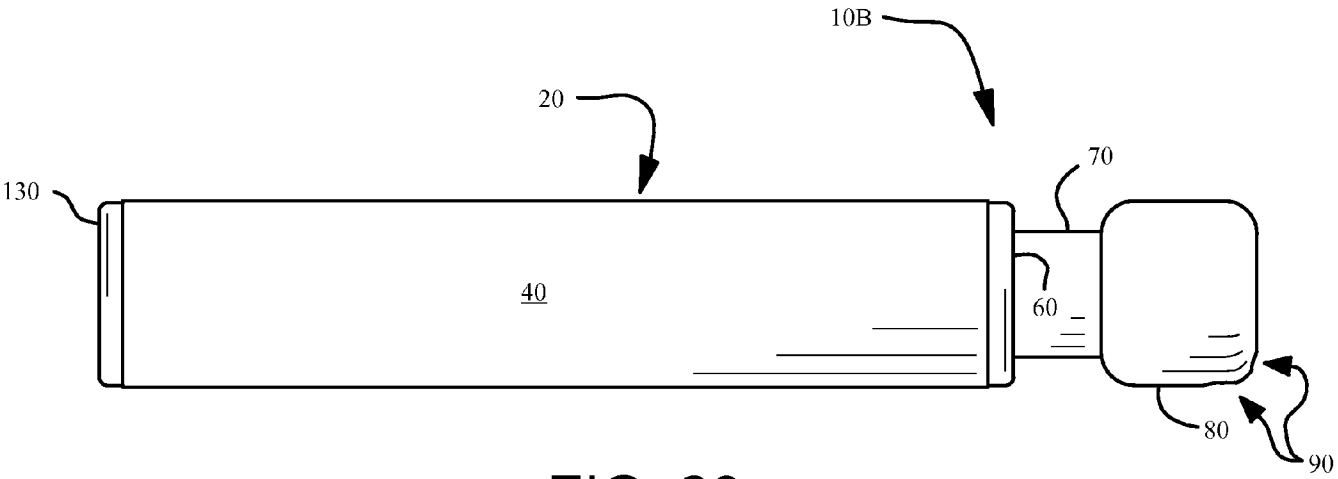
FIG. 20 is a front view of the embodiment in FIG. 19 lying horizontally, shown with the inner body in a neutral position (although not the only possible neutral position for this embodiment, it is used for convenience as the basis for references herein to this embodiment being in the neutral position).
Figure 21:
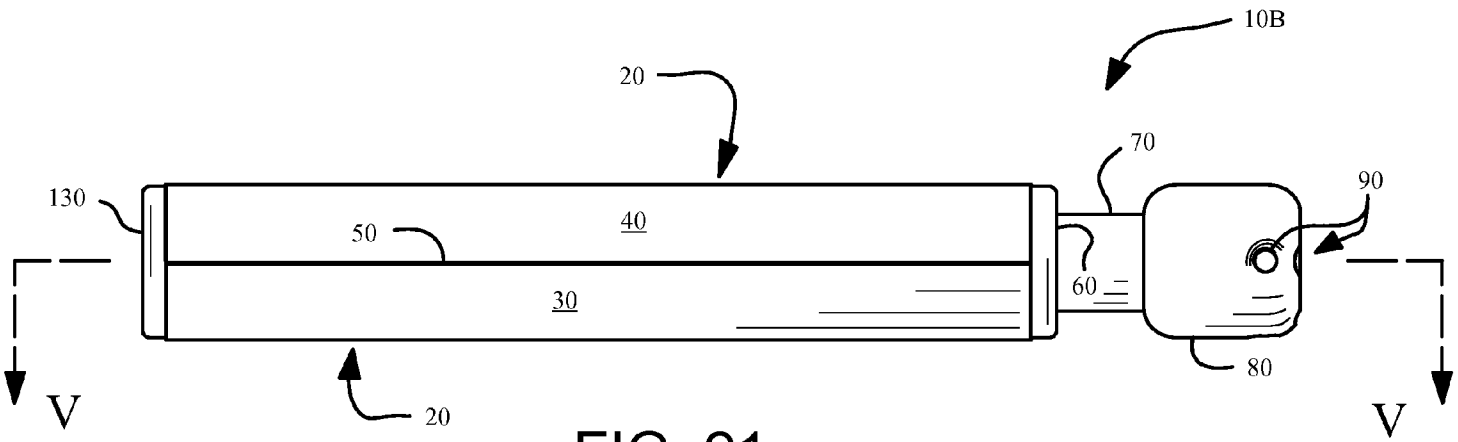
FIG. 21 is a right side view of the embodiment in FIG. 20, shown with the inner body in the neutral position.
Figure 22:
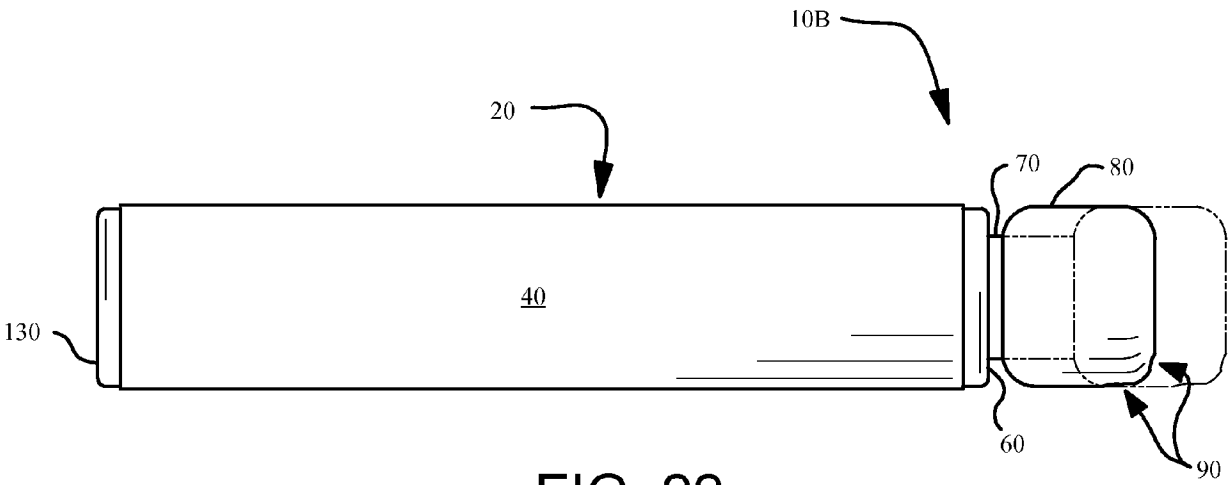
FIG. 22 is a front view of the embodiment in FIG. 20, shown with the inner body in a dispensing position (same parenthetical note as in above reference to FIG. 20 except "neutral position" is replaced by "dispensing position"), with phantom lines included as a reference to the neutral position.
Figure 23:
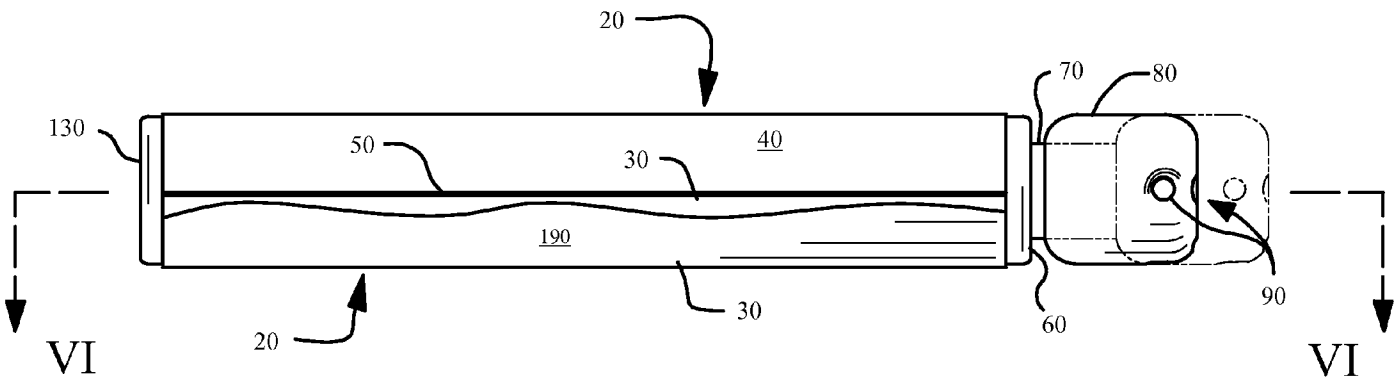
FIG. 23 is a right side view of the embodiment in FIG. 22, shown with the inner body in the dispensing position, with phantom lines included as a reference to the neutral position.
Figure 28:
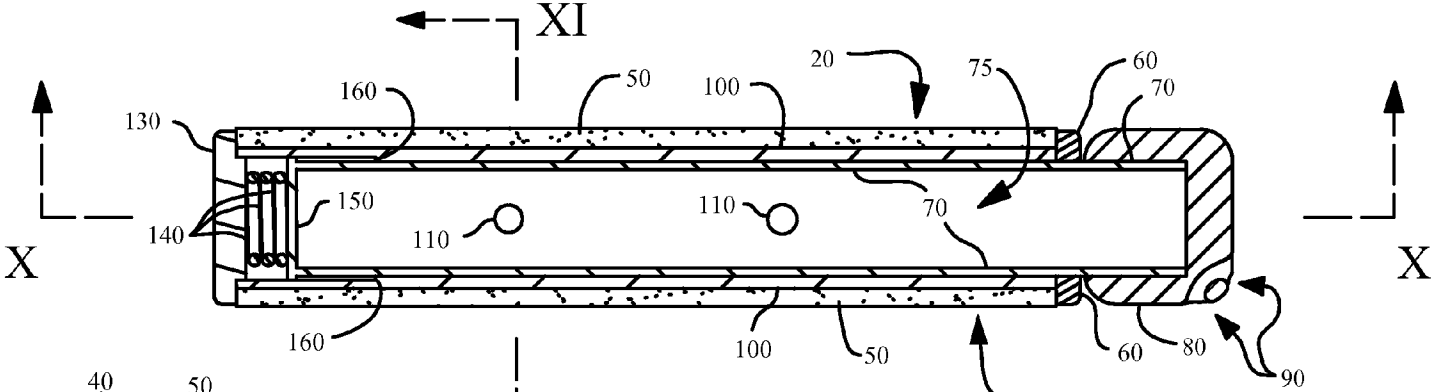
FIG. 28 is a front cross-sectional view of the embodiment in FIG. 22 as seen through section cut VI-VI, shown lying horizontally with the inner body in the dispensing position.
Figure 31:
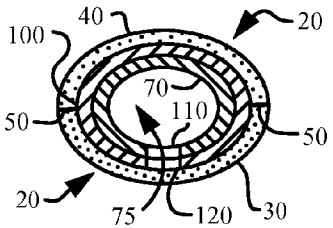
FIG. 31 is a transverse cross-sectional view of the embodiment in FIG. 30 as seen through section cut XII-XII.
Figure 29:
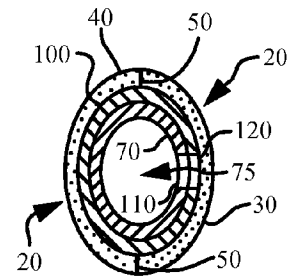
FIG. 29 is a transverse cross-sectional view of the embodiment in FIG. 28 as seen through section cut XI-XI.
Figure 30:
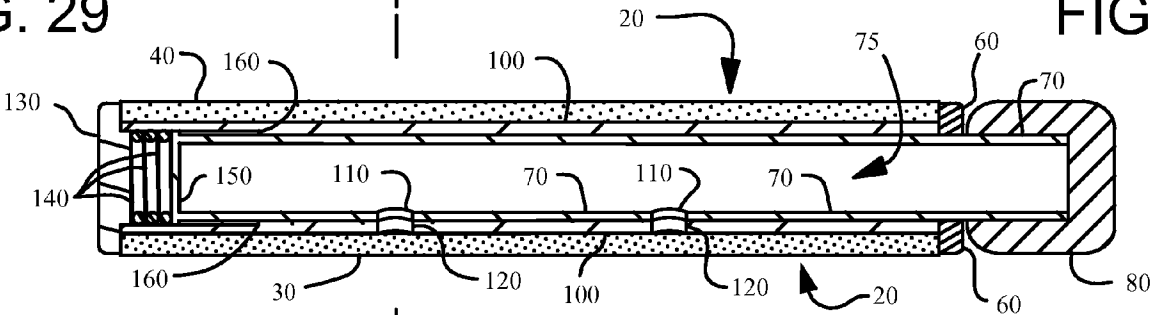
FIG. 30 is a right side cross-sectional view of the embodiment in FIG. 28 as seen through section cut X-X, shown lying horizontally with the inner body in the dispensing position.
Figure 32:
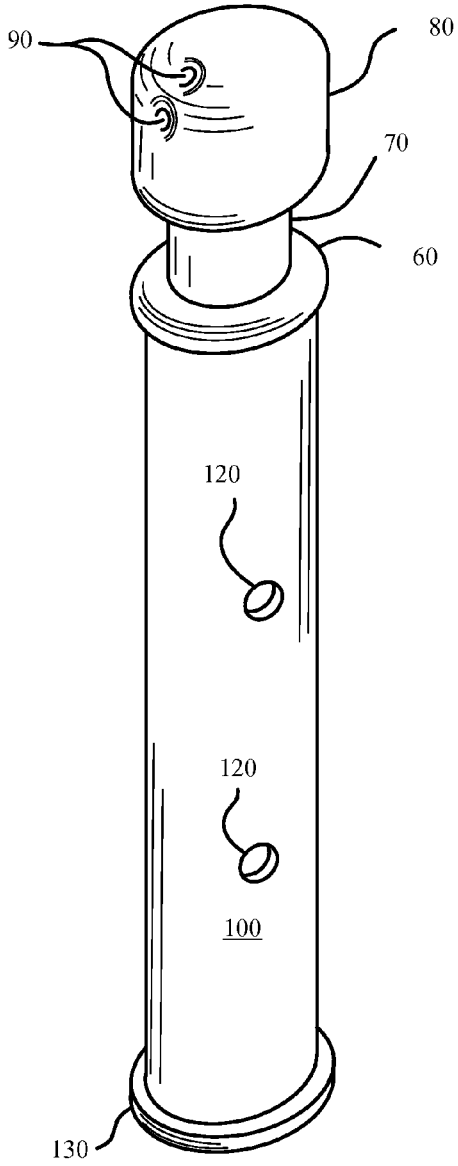
FIG. 32 is a perspective view of the embodiment in FIG. 19 (with the direction of the view being from the back upper-right rather than from the front upper-right as in FIG. 19), shown without its cleaning element.
Figure 33:
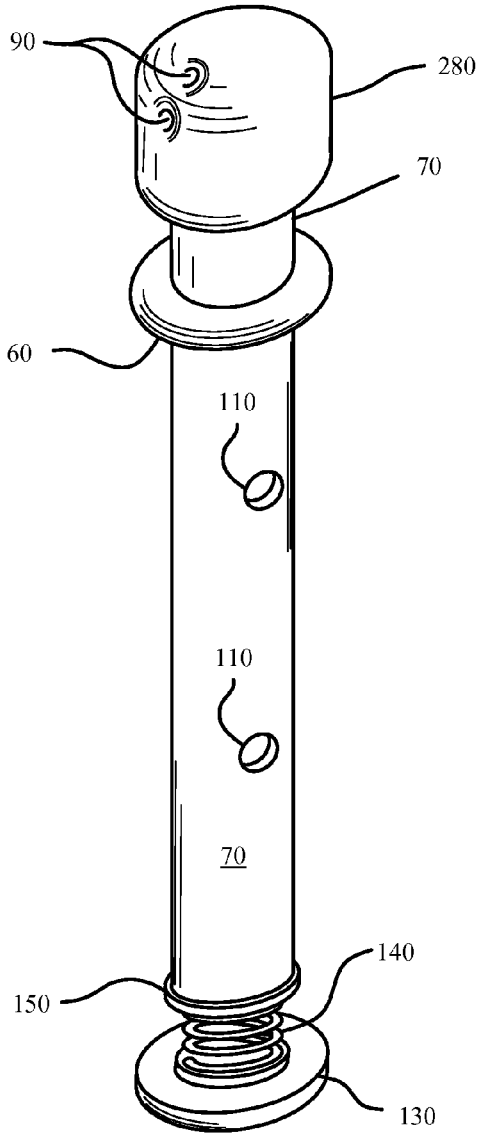
FIG. 33 is a perspective view of the embodiment in FIG. 19 (with the direction of view the same as in FIG. 32), shown without its cleaning element and without its main body (except for the main body base).

FIGS. 8 and 9 (FIGS. 20 and 21, for the embodiment referred to as the second cleaning device 10B, which is described further below in connection with FIGS. 19-33) show the first cleaning device 10A (the second cleaning device 10B in FIGS. 20 and 21) with its inner body 70 in the neutral position, lying horizontally, as seen from its right side in FIG. 8 (FIG. 21 for the second cleaning device 10B) and as seen from its front in FIG. 9 (FIG. 20 for the second cleaning device 10B). FIGS. 10 and 11 (FIGS. 22 and 23 for the second cleaning device 10B), show the first cleaning device 10A (second cleaning device 10B in FIGS. 22 and 23) with its inner body 70 in the dispensing position (the neutral positions of the inner body 70 and its attached knob 80 being shown in phantom lines). FIG. 10 (FIG. 23 for the second cleaning device 10B) shows the wetting part 30 of the cleaning element 20 with a wetted section 190 appearing below the impermeable barrier 50 as a result of the fluid passing from the reservoir 75 (not visible in these figures) into the cleaning element 20. And, FIG. 11 illustrates an example of the wetted section 190 covering most of the back half of the cleaning element 20. (Note that although each of the sectional cuts III-III, IV-IV, X-X, XI-XI and XII-XII is shown (see FIGS. 10, 11, 28 and 30) cutting through one of the wetted sections 190 illustrated in FIGS. 10, 11 and 23, the wetted sections 190 are not also illustrated in the figures showing the sectional views associated with those cuts.)

Figure 6:
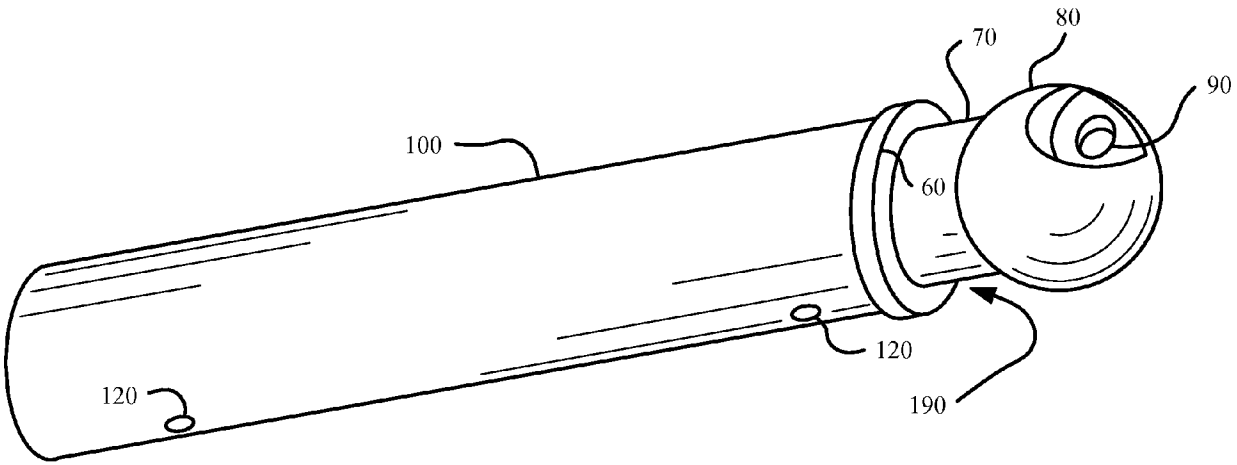
FIG. 6 is a perspective view of the embodiment in FIG. 3, shown without its cleaning element.
Figure 7:
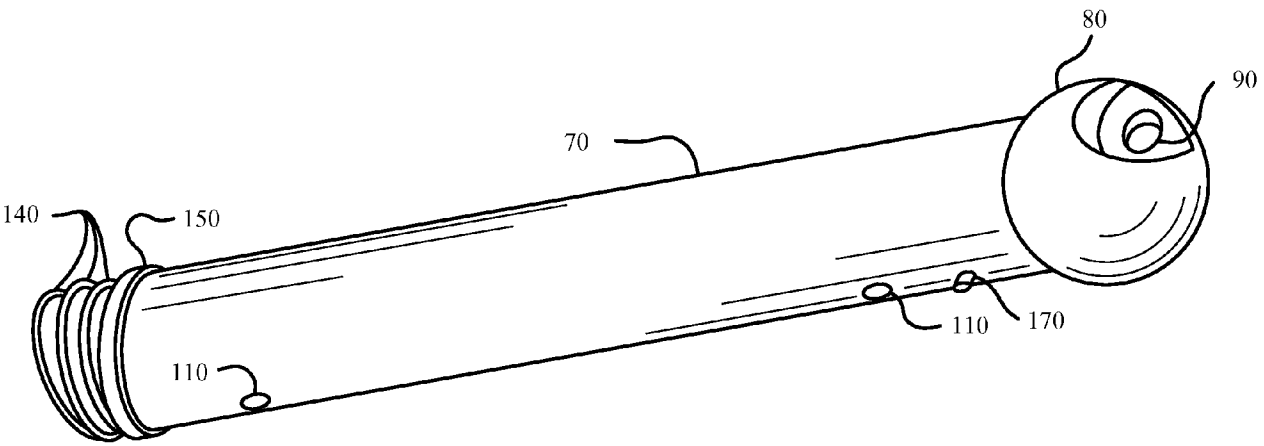
FIG. 7 is a perspective view of the embodiment in FIG. 6, shown without its cleaning element and without its main body.

In order to more fully illustrate the relationship between the cleaning element 20, the main body 100, and the inner body 70, FIG. 6 (and FIG. 32, for an embodiment having a different transverse cross-sectional shape) shows the inner body 70, in the neutral position, without the view being obstructed by the presence of the cleaning element 20 covering the main body 100. And, FIG. 7 (and, FIG. 33, for an embodiment having a different transverse cross-sectional shape) shows the first cleaning device 10A, still in the neutral position, not only without the view being obstructed by the presence of the cleaning element 20 covering the main body 100, but also without the view being obstructed by the main body 100 itself. Note, however, that while FIG. 7 does not show where the main body base 130 would be located, it does show the presence of the spring biasing device 140 and the location of the pin 170 (the slot 180 not being shown due to the absence of the main body 100). (FIG. 33 does show where its main body base 130 would be located as well as its spring biasing device 140, there being no need for a pin 170 (or a slot 180) on the embodiment of the cleaning device 10B shown in that figure, since the transverse cross-sectional shapes of its inner body 70 and main body 100 fit together in a way that serves as its set of anti-twist parts.)

Figure 15:
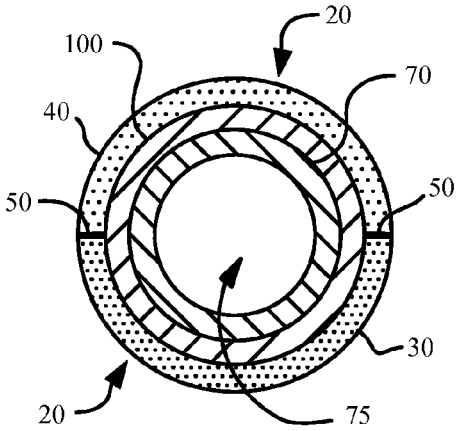
FIG. 15 is a transverse cross-sectional view of the embodiment in FIG. 10 as seen through section cut IV-IV (a transverse cut).
Figure 16:
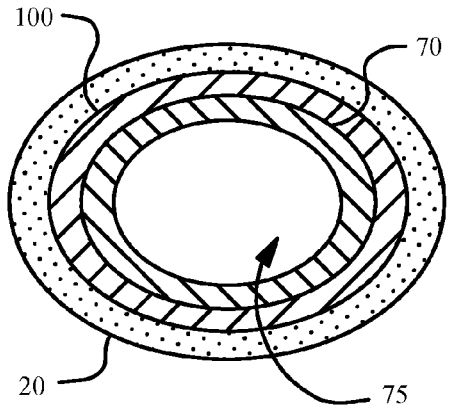
FIGS. 16-18 are transverse cross-sectional views of examples of alternative embodiment cross-sectional shapes, as they would be seen through section cut IV-IV in FIG. 10 if the embodiment in FIG. 10 were changed from a circular transverse cross-sectional shape to one of the non-circular alternative transverse cross-sectional shapes shown and had no impermeable barrier.
Figure 17:
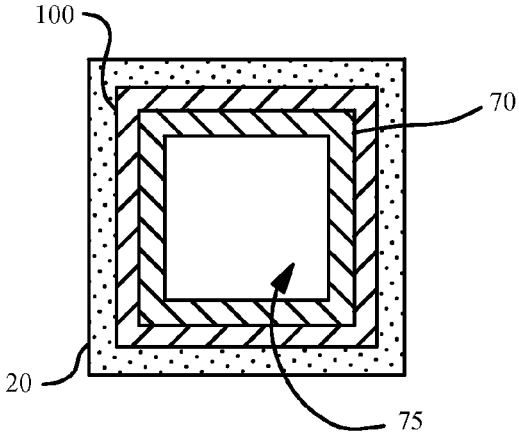
Figure 18:
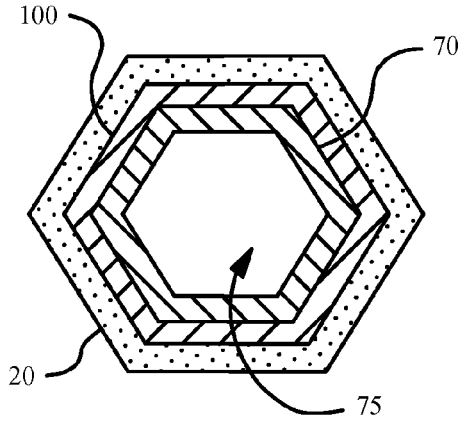
Figure 19:
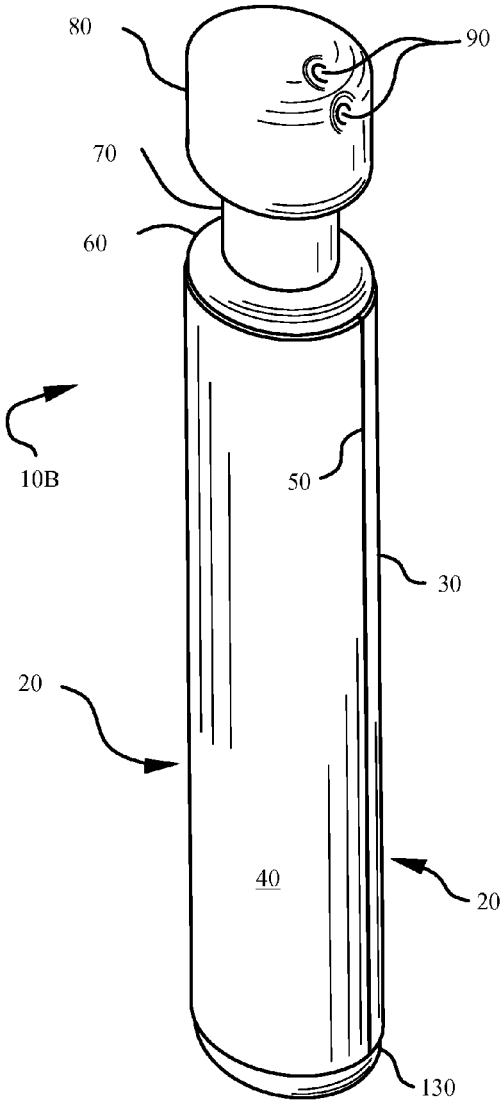
FIG. 19 is a perspective view of an embodiment of the present invention having a transverse cross-sectional shape similar to that shown in FIG. 16.
Figure 19A:
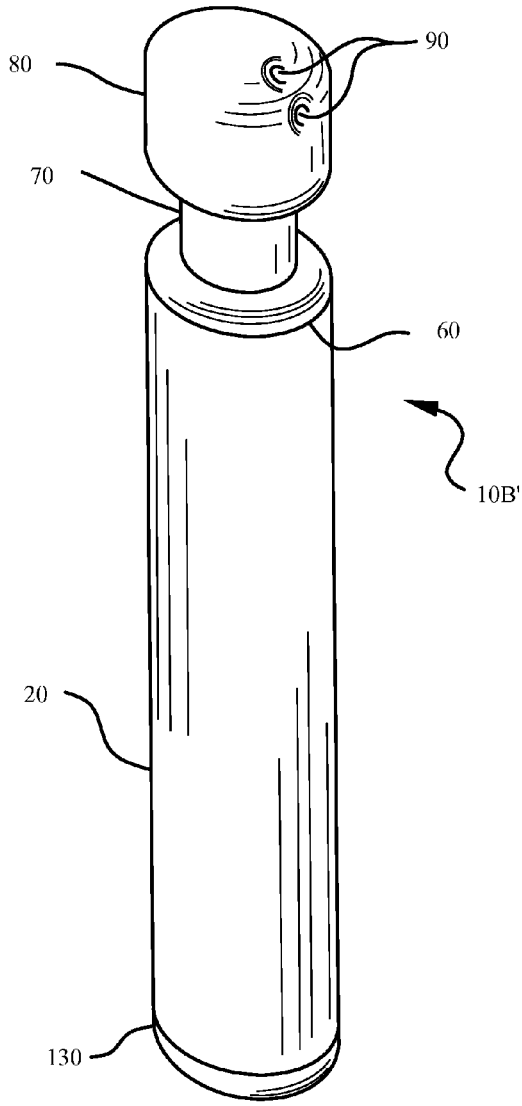
FIG. 19A is a perspective view of an embodiment substantially similar to that in FIG. 19, but shows a version of FIG. 19 that illustrates an embodiment of the invention with a cleaning element that does not include an impermeable barrier and does not protrude beyond the outer extents of the main body pieces at the top and bottom of the cleaning element (which are the main body base at its bottom, and the bushing, at its top).

FIG. 15 shows the circular transverse cross-sectional shape of the cleaning element 20, main body 100, and inner body 70 of the first cleaning device 10A that is the subject of FIGS. 3-14. While FIG. 15 shows an impermeable barrier 50 in order to properly represent the embodiment in FIG. 3, which has such a barrier; the barrier 50 may be removed from FIG. 15, for it to represent an alternative embodiment that exercises the option not to include a barrier as part of the cleaning element 20. FIGS. 16-18 show, without intending to limit the scope of the invention to only them, examples of transverse cross-sectional shapes of those parts for alternative embodiments of the invention (these figures show no impermeable barrier 50, so represent the option of alternative embodiments for having no barrier as part of the cleaning element 20.). FIGS. 19-33 show an alternative embodiment, in the form of second cleaning device 10B, in which the transverse cross-sections of those parts are generally represented by the cross-sectional view in FIG. 16. The version depicted in FIG. 19A is substantially similar to that in FIG. 19 but reflects the option of having no impermeable barrier 50 as part of the cleaning element 20 (as well as having the outer extents of the cleaning element 20 match the outer extents of its main body base 130 and its bushing 60), and is referred to as the no-barrier second cleaning device 10B'. (Note that the figures herein do not always show the constituent wetting part 30 and, if any, drying part 40 separately from the cleaning element 20, as seen in FIGS. 1 and 2, illustrating an embodiment in a generic form, and in FIGS. 16-18 and 19A, illustrating embodiments that have no impermeable barrier 50.)

In FIGS. 19-33, the parts that are comparable to their counterpart parts shown in FIGS. 3-14 (even though they may have some differences in their respective shapes, most notably the transverse cross-sectional shapes of the cleaning element 20, inner body 70, and main body 100, the alternative shapes shown for the main body base 130, the knob 80, and the attachment hole 90, and the differences in elongation of the overall cleaning device 10A,10B) are identified by the same name and number as their counterpart parts. FIGS. 19-33 are described to a large extent in connection with FIGS. 3-14, but it may be helpful to note that the non-circular transverse cross-sectional shapes of the cleaning element 20, the main body 100, and the inner body 70 of the second cleaning device 10B that is the subject of FIGS. 19-33 obviates the need for any additional anti-twist parts (such as the pin 170 and slot 180). In addition, FIGS. 24-33 show front, side and sectional cut views of this second cleaning device 10B to illustrate the appearance of those comparable parts from those points of view. For example, a comparison of FIGS. 24, 26, 28 and 30 shows the second cleaning device 10B wider in a front view than in a side view and the spring biasing device 140 not fitting as snuggly in the space provided for it as it does in a side view (which snugness, combined with the elliptical nature of the transverse cross-sectional shape of the main body 100, tends to prevent the spring 140 from slipping sideways, although, alternatively, a spring shaped to conform more fully to the space could be used to further help prevent such slippage). And, FIGS. 25, 27, 29 and 31 provide a transverse cross-sectional view of the relationships between the inner body hole 110 and the main body hole 120 while the inner body 70 is in the neutral position (shown in FIGS. 25 and 27) and when the inner body 70 is in the dispensing position (shown in FIGS. 29 and 31). Furthermore, note that while FIGS. 25, 27, 29 and 31 show an impermeable barrier 50 in order to properly represent FIGS. 24, 26, 28 and 30, which are based on FIG. 19; the barrier 50 may be removed from FIGS. 19, 21, 23-25, 27-29, and 31, for those figures to represent an alternative embodiment that exercises the option not to include a barrier as part of the cleaning element 20, as would be the case if they represented the no-barrier second cleaning device 10B' shown in FIG. 19A.

It should be understood that the present invention contemplates and includes all conventional adjustments and modifications to the embodiments described or shown herein, including alternate embodiments of the present invention that have conventional differences in size, shape, proportion, orientation, or direction of movement from those described or shown herein, without departing from the present invention.

Accordingly, the invention claimed is not limited to the embodiments described or shown herein, but encompasses any and all embodiments within the scope of the claims and is limited only by such claims.

What is claimed is:

1. A surface cleaning device, wherein the cleaning device comprises:

a. a cleaning element comprising a wetting part, the wetting part having a wetting part inner surface and a wetting part outer surface, wherein the wetting part is permeable to a cleaning fluid for allowing communication of the fluid from the wetting part inner surface to the wetting part outer surface for application of the fluid onto a cleanable surface;

b. a main body comprising a main body wall, wherein the cleaning element at least partially surrounds the main body, wherein the main body comprises a main body wall, the wetting part being supported at least in part by the main body wall, wherein the main body wall comprises a main body hole through it, and wherein at least a portion of the main body hole is proximate the wetting part for allowing the fluid to flow from the main body hole to the wetting part;

c. an inner body comprising a reservoir and an inner body wall, the inner body wall being disposed between the reservoir and the main body wall, wherein the inner body is slideable relative to the main body for allowing movement of the inner body between a neutral position and a dispensing position, and wherein the inner body wall comprises an inner body hole through it, the reservoir being in fluid communication with the inner body hole; and, d. a fluid-resistant seal, the seal comprising an absence of overlap between the inner body hole and the main body hole and a fit between a portion of the inner body wall and a portion of the main body wall wherein the fit is effective for at least impeding flow of the fluid from the inner body hole to the main body hole while the inner body is in the neutral position, and wherein movement of the inner body from the neutral position to the dispensing position opens a fluid pathway leading from the inner body hole into the main body hole.

2. The cleaning device of claim 1, wherein the cleaning element further comprises a cleaning element drying part, the drying part being supported at least in part by the main body wall, and wherein the drying part is capable of absorbing or adsorbing at least some of the fluid from the cleanable surface.

3. The cleaning device of claim 1 further comprising a biasing means, wherein the biasing means urges the inner body to move, relative to the main body, toward the neutral position.

4. The cleaning device of claim 3 further comprising a stopping component, wherein the stopping component is fixed relative to the main body, and wherein the stopping component is located for limiting the longitudinal outward movement of the inner body relative to the main body.

5. The cleaning device of claim 1 further comprising a first anti-twist feature fixed relative to the inner body and a second anti-twist feature fixed relative to the main body, wherein one of the two anti-twist features is configured to engage the other of the two anti-twist features for resisting twisting movement of the inner body relative to the main body.

6. The cleaning device of claim 2 further comprising an impermeable barrier, wherein the barrier is disposed between the wetting part and the drying part.

7. The cleaning device of claim 2 further comprising a biasing means, wherein the biasing means urges the inner body to move, relative to the main body, toward the neutral position.

8. The cleaning device of claim 7 further comprising a stopping component, wherein the stopping component is fixed relative to the main body, and wherein the stopping component is located where it intercepts a path of movement of at least part of the inner body for limiting outward movement of the inner body relative to the main body.

9. The cleaning device of claim 2 further comprising a first anti-twist feature fixed relative to the inner body and a second anti-twist feature fixed relative to the main body, wherein one of the two anti-twist features is configured to engage the other of the two anti-twist features for resisting twisting movement of the inner body relative to the main body.

10. The cleaning device of claim 3 further comprising a first anti-twist feature fixed relative to the inner body and a second anti-twist feature fixed relative to the main body, wherein one of the two anti-twist features is configured to engage the other of the two anti-twist features for resisting twisting of the inner body relative to the main body.

11. The cleaning device of claim 7 further comprising an impermeable barrier, wherein the barrier is disposed between the wetting part and the drying part.

12. The cleaning device of claim 4 further comprising a first anti-twist feature fixed relative to the inner body and a second anti-twist feature fixed relative to the main body, wherein one of the two anti-twist features is configured to engage the other of the two anti-twist features for resisting twisting movement of the inner body relative to the main body.

13. The cleaning device of claim 8 further comprising an impermeable barrier, wherein the barrier is disposed between the wetting part and the drying part.

14. The cleaning device of claim 9 further comprising an impermeable barrier, wherein the barrier is disposed between the wetting part and the drying part.

15. A surface cleaning device for cleaning at least part of a cleanable surface, the cleaning device comprising:

(a) a cleaning element comprising an element inner surface, an element outer surface, a wetting part, and a drying part, wherein the wetting part is capable of absorbing a cleaning fluid through the element inner surface and communicating the fluid to the element outer surface for application of the fluid onto the cleanable surface, and wherein the drying part is adjacent the wetting part and is capable of drying at least some of the fluid from the cleanable surface;

(b) a main body comprising a tubular main body wall, the main body wall providing support for the cleaning element wherein the cleaning element forms a sleeve at least partially about the main body, and wherein the main body comprises a main body hole through the main body wall, the main body hole being located for allowing the fluid to flow from the main body hole to the cleaning element inner surface;

(c) an inner body comprising a tubular inner body wall, an inner body base, a knob, and a reservoir, wherein at least a portion of the inner body wall is located within the main body, wherein the reservoir is located between the inner body base and the knob and is at least partially surrounded by the inner body wall, wherein the knob is attached to the inner body with at least a portion of the knob located outside the main body for application of finger pressure against the knob, wherein the inner body comprises an inner body hole through the inner body wall and the reservoir is in fluid communication with the inner body hole, and wherein the inner body is slideable longitudinally relative to the main body for allowing movement of the inner body between a neutral position and a dispensing position;

(d) a fluid-resistant seal comprising a fit between at least a portion of the inner body wall and at least a portion of the main body wall and a space separating the inner body hole from the main body hole while the inner body is in the neutral position, the fit being located at least in part within the space, wherein the fit prevents or impedes the flow of fluid from the inner body hole to the main body hole; and, wherein, movement of the inner body from the neutral position to the dispensing position modifies or eliminates the space, to open a fluid pathway leading from the inner body hole into the main body hole;

(e) a biasing means, wherein the biasing means is located and configured to urge the inner body in an outward direction for resisting movement of the inner body from the neutral position toward the dispensing position, and for moving the inner body from the dispensing position to the neutral position;

(f) a stopping component, wherein the stopping component is fixed relative to the main body, and wherein the stopping component intercepts a path of outward movement of at least part of the inner body for limiting the outward movement of the inner body relative to the main body; and, (g) anti-twist features, wherein the anti-twist features comprise an inner body anti-twist part and a main body anti-twist part, the inner body anti-twist part being secured or integral to the inner body and the main body anti-twist part being secured or integral to the main body, wherein the two anti-twist parts engage one another for resisting twisting movement of the inner body relative to the main body to help prevent misalignment circumferentially between the inner body hole and the main body hole while the inner body is in the dispensing position.

16. The cleaning device of claim 15, further comprising an impermeable barrier, wherein the barrier is located between the drying part and the wetting part for separating at least part of the drying part from at least part of the wetting part.

17. The cleaning device of claim 15 wherein one of the two anti-twist parts comprises a pin and the other of the two anti-twist parts comprises a slot.

18. The cleaning device of claim 16 wherein one of the two anti-twist parts comprises a pin and the other of the two anti-twist parts comprises a slot.

19. The cleaning device of claim 15 wherein the inner body anti-twist part comprises an inner body wall surface having a non-circular transverse cross-sectional shape, and wherein the main body anti-twist part comprises a main body wall surface having the same or a different non-circular transverse cross-sectional shape.

20. The cleaning device of claim 16 wherein the inner body anti-twist part comprises an inner body wall surface having a non-circular transverse cross-sectional shape, and wherein the main body anti-twist part comprises a main body wall surface having the same or a different non-circular transverse cross-sectional shape.

* * * * *